United States Patent [19]

Ebbert et al.

[11] 4,130,006

[45] Dec. 19, 1978

[54] RIVETING SYSTEM

[75] Inventors: Robert J. Ebbert; John V. Brown, both of Rochester, Mich.

[73] Assignee: Ebbert Engineering Company, Troy, Mich.

[21] Appl. No.: 827,793

[22] Filed: Aug. 25, 1977

Related U.S. Application Data

[63] Continuation-in-part of Ser. No. 105,686, Jul. 15, 1976, Pat. No. 4,062,217.

[51] Int. Cl.[2] ..... B21J 15/34

[52] U.S. Cl. ..... 72/391

[58] Field of Search ..... 72/391, 453.17, 114

[56] References Cited

U.S. PATENT DOCUMENTS

| | | | |
|---|---|---|---|
| B 516,537 | 2/1976 | Champoux | 72/391 |
| 2,088,859 | 8/1937 | Huck | 72/391 |
| 3,082,898 | 3/1963 | Bosch | 72/453.17 |
| 3,363,445 | 1/1968 | Sanders | 72/391 |
| 3,415,102 | 12/1968 | Elliott | 72/391 |
| 3,451,248 | 6/1969 | Bell | 72/453.17 |
| 3,457,763 | 7/1969 | Freeman | 72/453.17 |
| 3,523,441 | 8/1970 | Bell | 72/453.17 |
| 3,630,067 | 12/1971 | Henshaw | 72/391 |
| 3,898,833 | 8/1975 | Richardson | 72/391 |
| 3,962,780 | 6/1976 | Kindig | 29/753 |

*Primary Examiner*—C.W. Lanham
*Assistant Examiner*—Gene P. Crosby

[57] ABSTRACT

A mobile production riveting system comprising a power actuated hand operated "gun" tool assembly for pulling and automatically collecting the mandrels of inserted blind rivets and panel mounted associated equipment including power supply, control valve, pressure regulator, vacuum transducer, mandrel retrieval system, hydraulic reservoir, and other support equipment for adapting a general factory air supply to power the hand tool under finger trigger control. Unusually fast cycle time results from a combination of improvement features including the limitation of vacuum venturi airflow for mandrel retrieval to a power-off portion of the cycle, the use of air pressure in lieu of a mechanical gun piston return spring, and a non-pumping system with respect to eliminating recycling of actuating hydraulic fluid to and from the hydraulic reservoir. An integrated assembly of all system equipment for operating the hand tool through connecting hose lines on a compact mobile suspension panel including a mandrel retrieving system accommodates efficient service over a wide range of operating space.

4 Claims, 11 Drawing Figures

RIVETING SYSTEM

PRIOR APPLICATION

This application is a continuation-in-part of our prior copending U.S. patent application Ser. No. 705,686 filed on July 15, 1976, now U.S. Pat. No. 4,062,217.

BACKGROUND OF THE INVENTION

Hand tools of the class involved with remote air/hydraulic power booster assemblies are known in the art. In some cases, vacuum retrieval systems for automatically collecting rivet mandrels pulled by the hand tools have been added to existing systems. Such retrieval systems may employ a vacuum pump but usually operate with a constant vacuum supply established by an induction venturi transducer involving a constant drain on the available air supply and, due to inherent restrictions in fittings from the general air supply, contribute to a pressure drop upon operation of the hand tool to perform its mandrel pulling function which undesirably limits the speed of operation and cycle time in setting successive multiple rivets.

The air/hydraulic power units of the prior art normally operate with the air piston in a forward position when the tool is idle drawing the hydraulic end of the piston to create actuating hydraulic pressure multiplied by differential areas. Hydraulic fluid is drawn from a reservoir to fill the chamber at the far end of the hydraulic piston and upon a fast return such oil gushes back into the reservoir frequently causing noise and aeration problems, particularly when the reservoir level is less than full.

The hydraulic piston on the hand tool is normally actuated to draw the mandrel gripping jaws against a return spring at the end of the piston which provides increasing resistance to the pulling force on the jaws and limited decreasing return force on the hydraulic fluid which, together with limited passage openings, tends to create a high vacuum in the return lines with any attempt to achieve a fast return in order to shorten the cycle time.

The limited space available for the return spring in the hand tool has led to over-stressed springs which, upon breaking, score the cylinder walls causing substantial maintenance problems; and the loss of spring pressure upon expansion corresponds to the end of the stroke when the jaw opening creates a need for the most return passage.

The absence of a fully integrated power supply and mandrel retrieval system in prior art installations has led to relatively bulky total systems rendering portability and mobility difficult and area of operated restricted.

SUMMARY OF THE INVENTION

The present fully integrated system has achieved remarkable improvements in reducing cycle time from about 3 seconds to 1 second, eliminating the source of severe maintenance problems, and in substantially contributing to the mobility and convenience of the total system. One of the key features in reducing cycle time involves the connection of the air supply for the vacuum transducer to a line which is exhausted during the power stroke of air cylinder and pressurized only during the return stroke at the end of which vacuum is required to dispose of the mandrel. Thus, upon actuation of the power unit such line is connected to exhaust and no air is consumed in maintaining a vacuum which is not needed until the end of the power stroke when the control trigger is released reestablishing air pressure in the return line and vacuum for withdrawing the mandrel from the hand tool and full air pressure passing through the limited supply connections is available to actuate the power unit with greatly improved speed and efficiency.

The power unit employed in the disclosed embodiment reverses the conventional power stroke of the piston in the air cylinder and employs the end of the air piston rod as the power rather than return end of the hydraulic piston thus avoiding any need for reciprocating flow of hydraulic fluid to and from the reservoir with each cycle of operation and the disadvantages attendant thereto.

The replacement of the return spring in the hand tool with an air pressure return further contributes to the reduction in cycle time by providing a higher force for more rapid and positive jaw opening. Avoidance of spring breakage with tool damage consequences likewise eliminates one of the serious service problems.

Airports are provided at the nose of the tool to enhance venturi airflow; and the mandrel tube associated with the mandrel gripping jaws movable during retraction of the mandrel preferably extends throughout the tool to an external hose connection preventing any possibility of damage from successive mandrels jamming within the tool.

A compact integrated arrangement of all elements of the system on a panel which can be conveniently suspended from a trolly track renders the entire system highly mobile over extended space requirements without excessively long power and control lines between the power unit station and the hand tool.

DESCRIPTION OF THE DRAWINGS

Referring to FIG. 1 the main components include a power unit assembly A, four-way control valve B, hydraulic reservoir C, air pressure regulator D, vacuum transducer E, vacuum regulator F, mandrel receptacle box G and mounting panel H. With reference to FIG. 6, the rivet gun hand tool assembly I is connected to the operating components by elements of the hose assembly I shown in FIG. 9.

Figure 1:
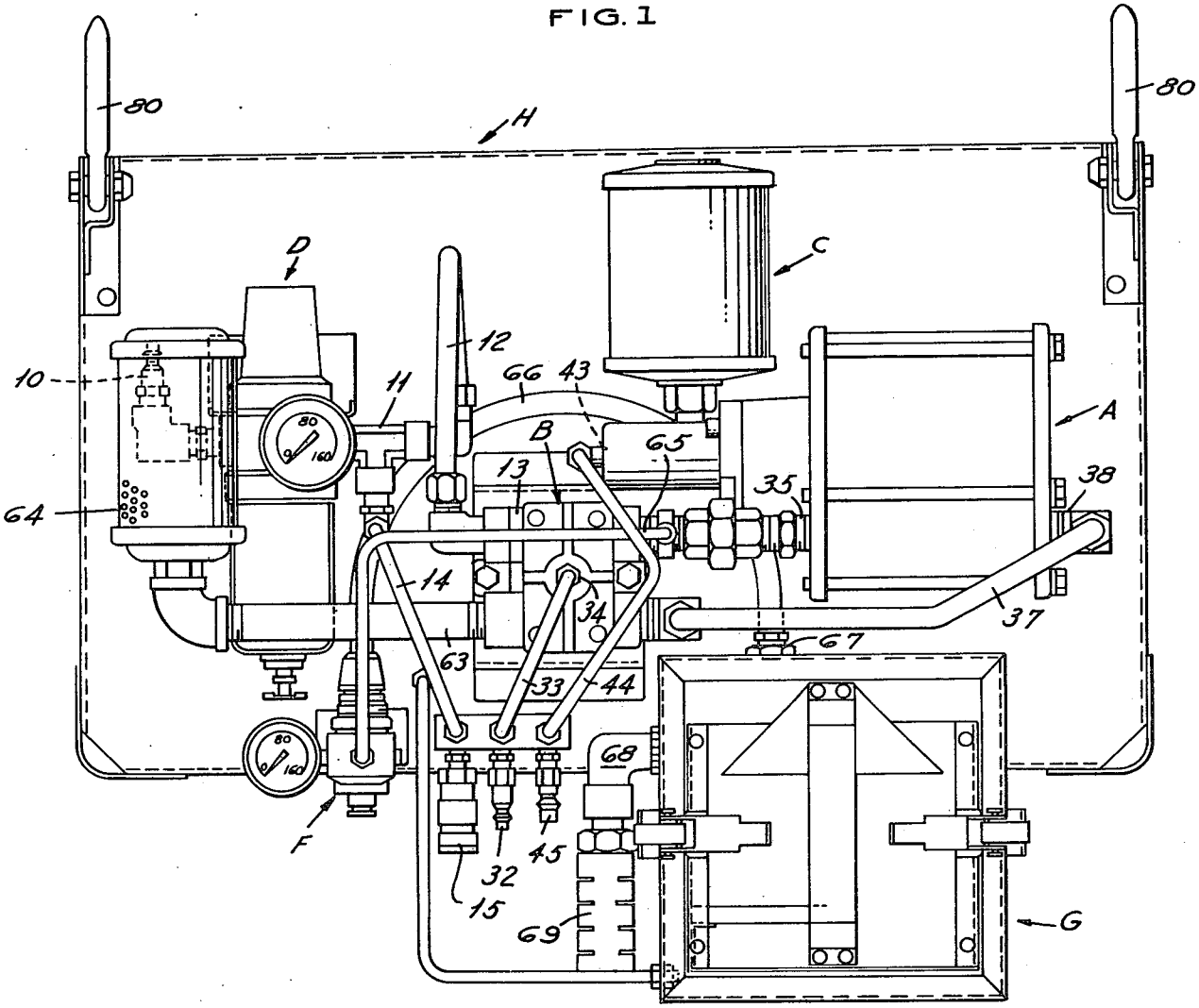
FIG. 1 is a front elevation of the riveting system panel assembly on which all of the equipment for operating the rivet gun is mounted.
Figure 2:
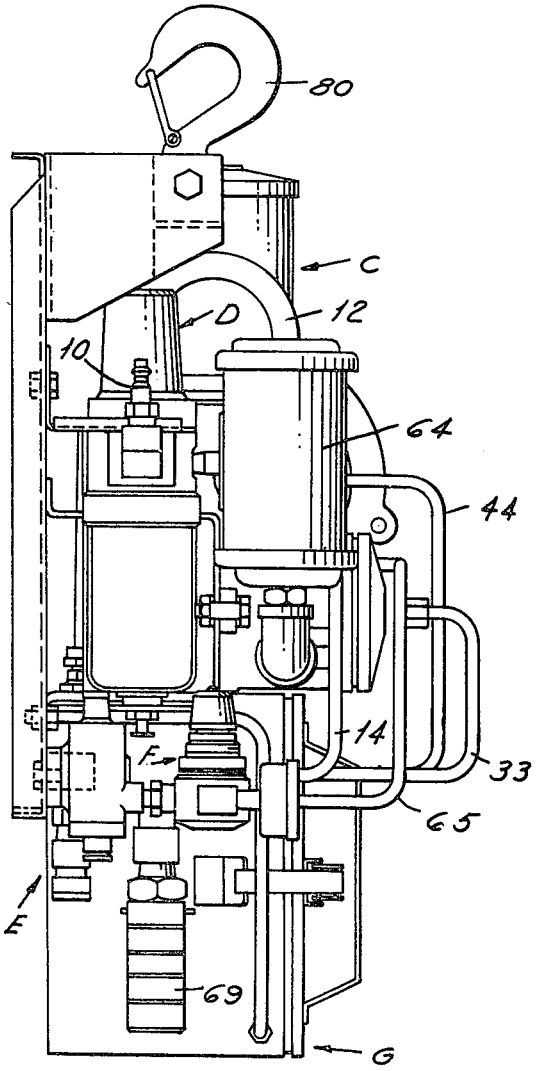
FIG. 2 is a left end elevation thereof.
Figure 3:
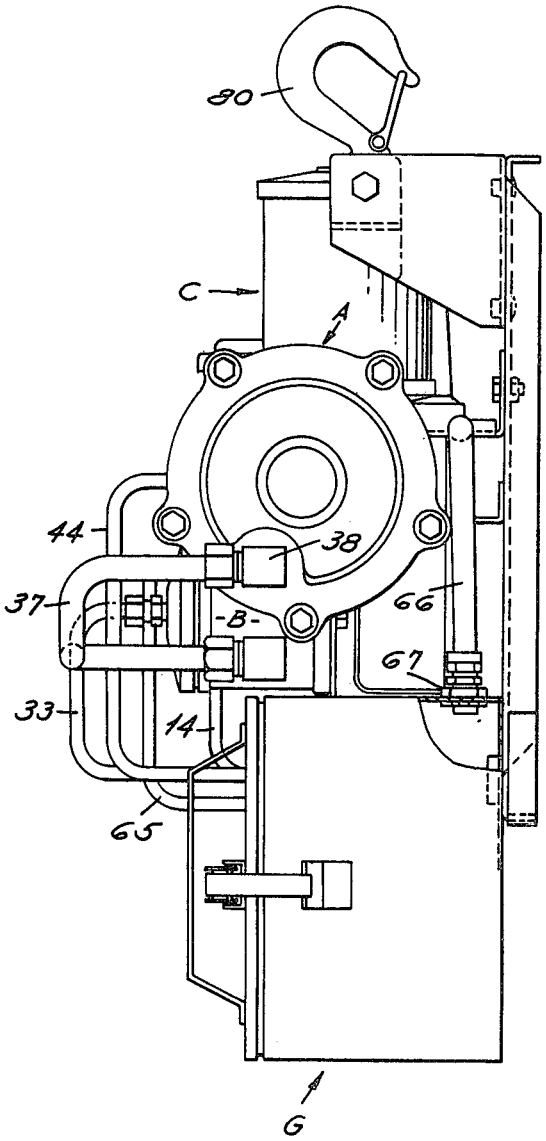
FIG. 3 is a right end elevation thereof.

In general the system operates on a combination of hydraulic power, air power and vacuum all developed from a common source of air pressure admitted to the system from an outside source of through an inlet 10. After passing through pressure regulator D regulated air pressure is led through a T-fitting 11, to a line 12 leading to an air inlet 13 in the four-way control valve B and through a branch line 14 to a fitting 15 for coupling to a hose line 16, shown in FIG. 9, connected to an inlet 17 in the valve block 18 formed at the top end of the handle 19 of the hand tool gun assembly I. Air pressure from the inlet 17 enters a valve passage 20 then through port 21 communicates with the central chamber 22 in cylinder 23 assembled to the valve block 18.

Figure 6:
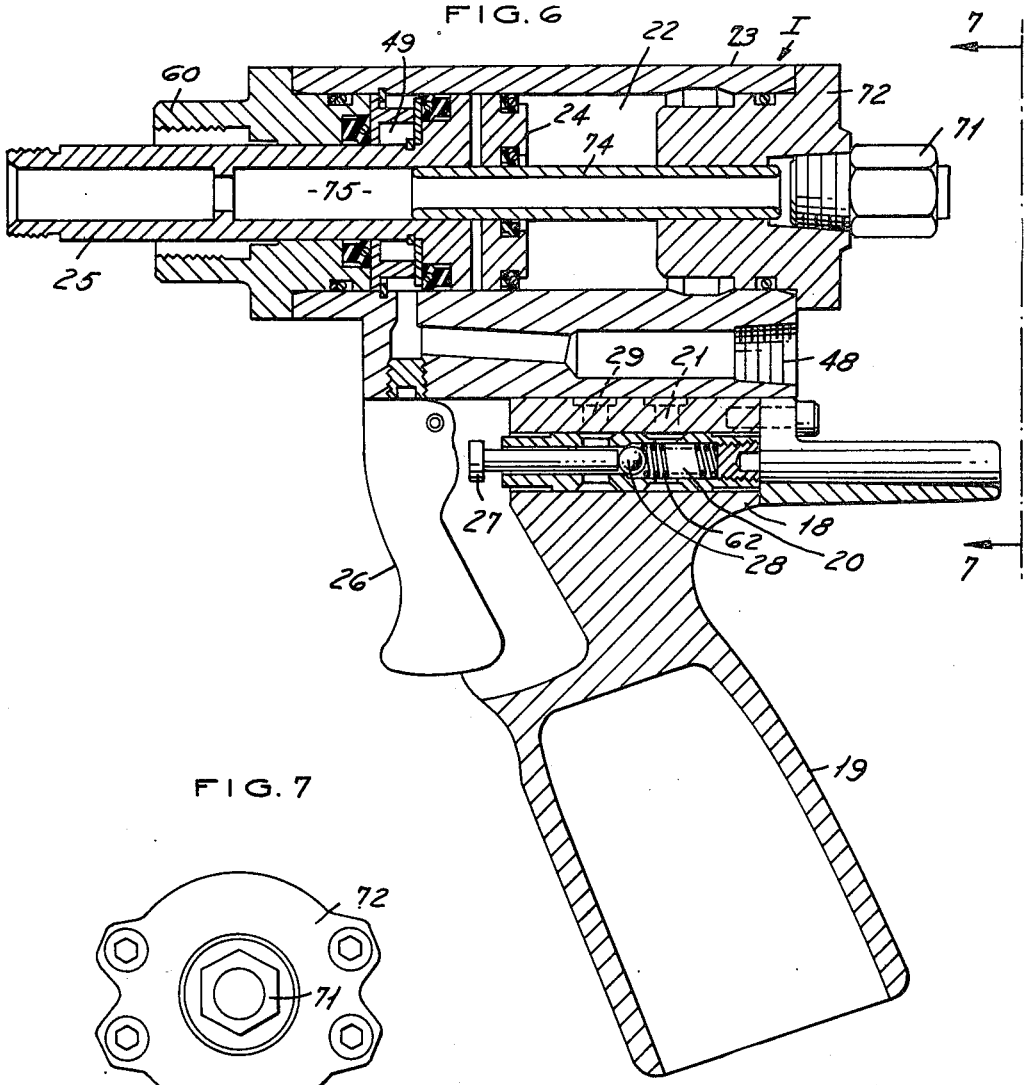
FIG. 6 is a sectional view of the hand tool rivet gun employed at the riveting station.
Figure 7:
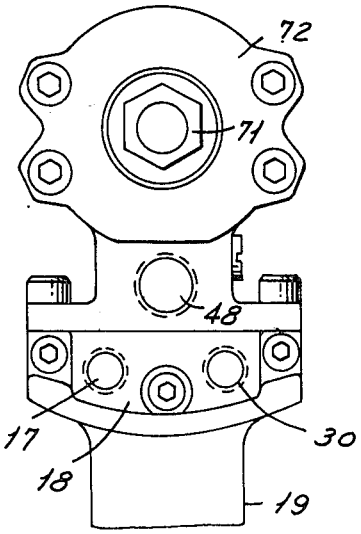
FIG. 7 is an end view taken along the line 7—7 of FIG. 6.

Air pressure in the chamber 22 during idling operation of the gun urges the piston 24 and its tubular end 25 to an extended position as shown in FIG. 6 with the jaws ready to receive the mandrel of a rivet manually inserted in the nose of the gun as hereafter described in detail. Actuation of a finger trigger 26 acting through push rod 27 unseats a ball check valve 28 admitting air pressure from the passage 20 to port 29 leading to a return outlet 30, shown in FIG. 7, and through hose connection 31, fitting 32 and control pressure line 33, to a control pressure port 34 in the four-way valve B.

Figure 4:
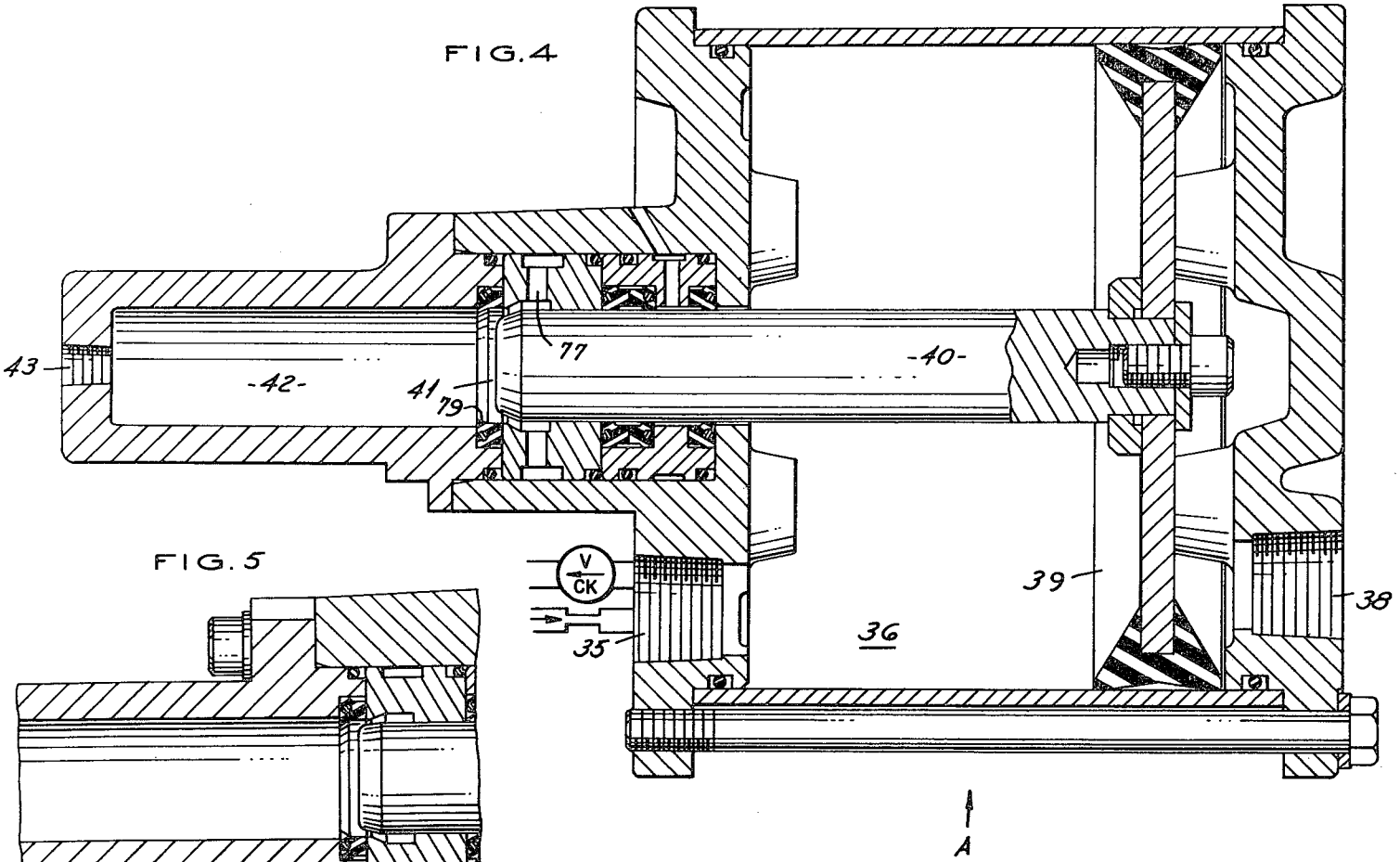
FIG. 4 is an enlarged sectional view of the power unit shown in FIG. 1.
Figure 5:
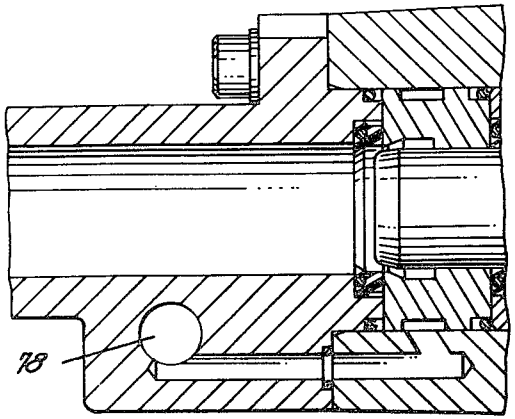
FIG. 5 is a fragmentary sectional view with the hydraulic piston and cylinder shown in FIG. 4 taken in a plane normal thereto.

Air pressure admitted to the port 34 shifts the spring return valve from its normal position where air pressure from the inlet port 13 communicates through the valve with an inlet 35 to the air chamber 36 of the power unit A. In its shifted position the valve connects air pressure to the line 37 leading to the other inlet 38 for actuating the air piston 39 from its normal retracted position as shown in FIG. 4 toward the left forcing the piston rod 40, the end of which 41 operates as a hydraulic piston, to the left into the hydraulic chamber 42 and from the outlet 43 thereof, oil passes to hydraulic pressure line 44 and fitting 45 through pressure line 46 and fitting 47 to the hydraulic inlet 48 leading to the hydraulic chamber 49 at the left hand of piston 24 forcing such piston to retract the piston end 25 to actuate the pulling head of the gun assembly as hereinafter described.

The differential area of the piston 24, which is limited to the cross sectional area of the tubular end 25, is relatively small compared to the differential area for converting air pressure to hydraulic pressure in the power unit A and accordingly substantially the entire multiple of hydraulic pressure is available to actuate the piston 24 against the constant air spring which is maintained in the air chamber 22 and a powerful force for pulling the piston end 25 within the cylinder 23 is thus provided.

Figure 8:
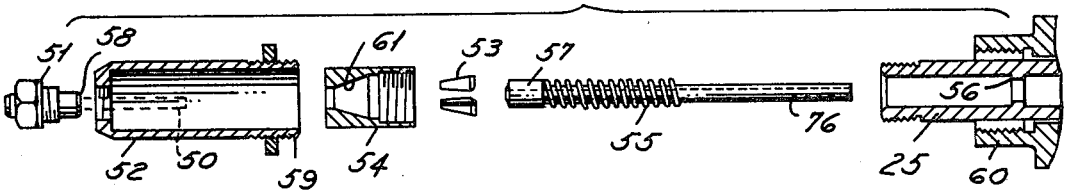
FIG. 8 is an expanded view of the pulling head components for the rivet gun.

Referring to FIG. 8, the mandrel 50 of a rivet inserted in the nose piece 51 fitted into the sleeve 52 extends between the open jaws 53 of the pulling head inside the collet 54. Such jaws are held open by the compression of spring 55 reacting against a shoulder 56 within the tubular piston end 25 which holds the tapered end of the jaw follower 56 against a matching taper in the jaws, the outer ends of the jaws being held open by engagement with the tapered end 58 forming an abutment projecting inwardly from the nose piece 51 when the collet 54 is in its most advanced release position. The inner end 59 of the sleeve 52 is inserted in the end 60 of the cylinder 23 in fixed relation thereto so that initial retraction of the piston 24 and extension 25 with collet 54 attached thereto provides an actuating engagement of the tapered walls 61 of the collet with the matching taper of the jaws 53 pulling them away from the abutment end 58 of the nose piece 51 and into gripping engagement with the mandrel 50 of the rivet. Such initial engagement is induced by the compressive reaction force of the preloaded spring 55 resisting retraction movement of the jaws 53 and as soon as the serrated inner surface of the jaws engage the mandrel the resistance of movement thereof is added to that of the spring 55 forcing the jaws more firmly into engagement with the mandrel assuring breakage thereof when the rivet is set and the tensile strength of the mandrel is exceeded.

Release of the trigger 26 causes the ball check valve 28 to re-seat under the pressure of return spring 62 sealing air pressure from port 29 which is exhausted through an orifice outlet, not shown, causing the spring return four-way control valve B to shift back to its normal position reconnecting air pressure to the inlet 35 and reconnecting the passage 35 to an exhaust outlet passage 63 and an exhaust outlet muffler 64. It will be understood that when the control valve is actuated to pressurize port 38 the inlet 35 becomes an exhaust port connected to the exhaust line 63 through the four-way control valve B.

With air pressure reintroduced into chamber 36 a retraction of the piston 41 takes place relieving hydraulic pressure on the piston 24 in the gun assembly and permitting air spring pressure in chamber 22 to return hydraulic fluid through the hose connection 46 to the chamber 42. It has been found advantageous to incorporate a one-way check valve with a metering orifice by-pass as shown schematically in FIG. 4 for restricting the inlet flow of air through the inlet 35 to an extent which will accommodate the return of hydraulic fluid without drawing an excessive vacuum on the lines due to their restricted openings and the limited force of the air pressure in chamber 22 to move the hydraulic fluid back to the power unit.

Figure 9:
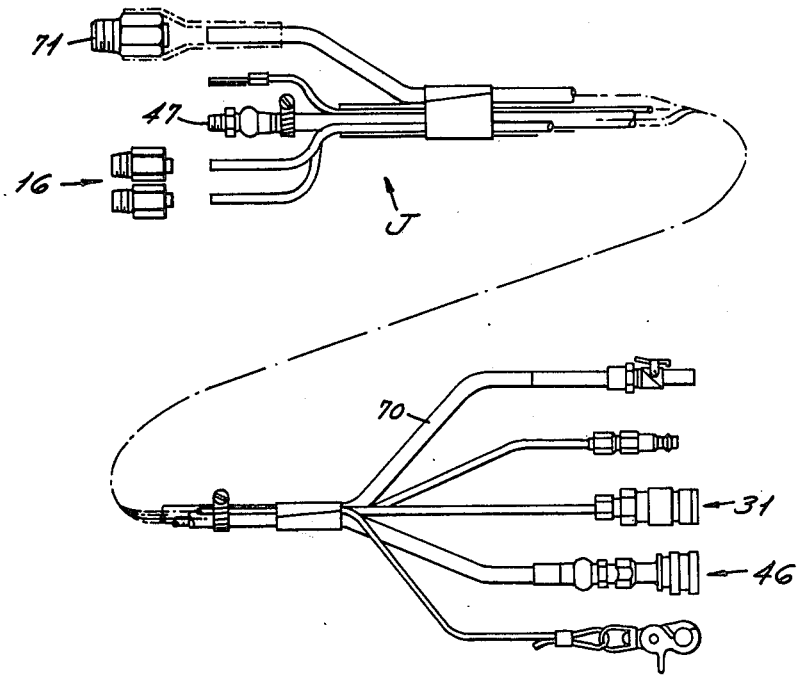
FIG. 9 is a schematic view of the hose assembly connecting the rivet gun to the operating equipment of the panel assembly.

Reestablishment of air pressure in the outlet of the control valve B leading to the inlet passage 35 also feeds air pressure to line 65 leading to vacuum transducer pressure regulator F and vacuum transducer E having a vacuum venturi outlet within the transducer aligned with a hose line 66 leading to an inlet connection 67 at the top of receptacle box housing G. An outlet 68 from such housing is provided through a muffler 69. With reference to FIGS. 6, 8 and 9 mandrel ejector tubing 70 and connector 71 in the end cap 72 of the cylinder 23 lead from a guide tube 74 fixed in the end cap 72 extending within the inner wall 75 of the piston end 25 within which the tubular guide 76 leading from the jaw follower 57 extends in sliding relation.

Thus, whenever the trigger 26 is released pressure in the line 65 establishes vacuum and air flow through the nose piece 51, collet 54, jaw follower 57, guide tube 76 and tubing connection 70 to the vacuum transducer E where the mandrel is then blown by the venturi outlet through hose line 66 for transporting the mandrel pulled from the rivet into the receptacle box G upon release by the jaws 53. Such release takes place through the outward movement of the piston end 25 to a point where the jaws 53 engage the tapered abutment 58 arresting their further travel while the collet continues releasing its wedging contact and the spring action 55 and tapered end of the jaw follower 57 cooperate with the tapered abutment 58 forcably separating the jaws from the mandrel leaving it free to move in the air current through the passage tubing leading to receptacle box G.

The connection of the vacuum transducer to a line pressurized only when the power mandrel pulling cycle has been completed and the trigger released is an important feature which has contributed substantially to an overall reduction in cycle time from approximately 3 seconds to 1 in the repeated operation of the tool. This is due to the fact that there is no constant drain on the air pressure source, limited through restricted connections, as would be the case if a vacuum were maintained during the power pulling cycle of the gun. Such air pressure drain may involve as much as 13 cubic feet per minute resulting in a substantial pressure drop during the power cycle and extending the time for pressure build up after clearance is taken up.

Another feature of importance in improving efficiency of operation, as shown in FIG. 4, is the arrangement permitting the piston end 41 in its initial movement to close off communication through port 77 and passage 78 with the reservoir C upon passing the edge of the lip seal 79 so as to avoid a surge of return hydraulic fluid into the reservoir during the return stroke of the gun piston as is typical of prior systems wherein the hydraulic piston is arranged to operate with differential piston areas involving a displacement of fluid from the reservoir to supply the power stroke and a return of fluid to the reservoir during each return stroke.

Mobility of the riveting system is provided by the compact integrated arrangement of all power and control equipment on a panel supported through hooks 80 adapted for overhead trolly or other transport suspension.

Figure 10:
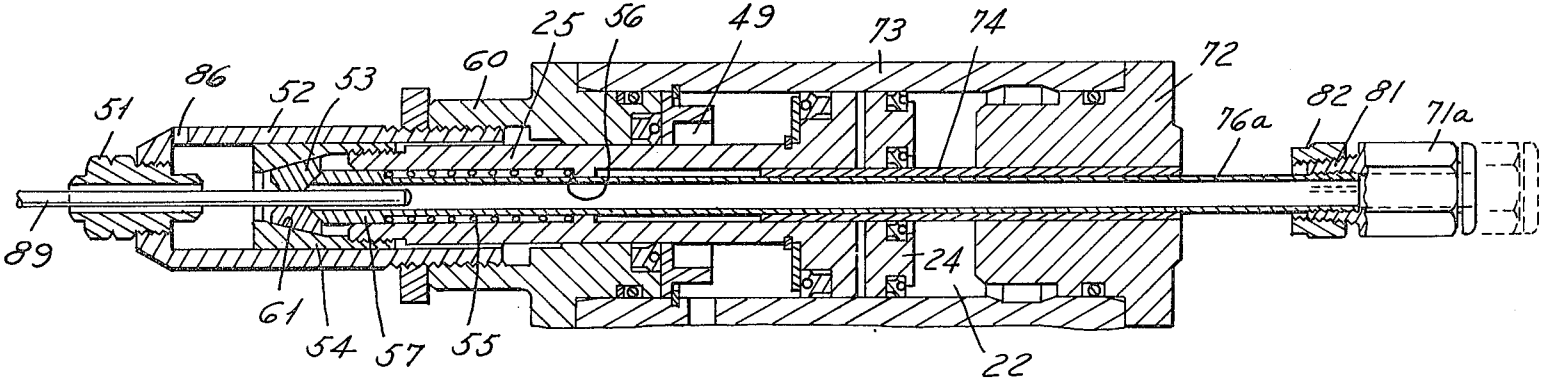
FIG. 10 is a fragmentary section view of the barrel portion of a modified rivet gun similar to that shown in FIG. 6.

With reference to FIG. 10, a modified form of movable tubular guide **76*a* is disclosed which extends entirely through the fixed guide tube 74 for external connection to fitting 71*a* having a split threaded end 81 tightly secured by compression nut 82. This construction is preferred over that disclosed in FIGS. 6 and 8 where the movable guide tube 76 terminates within the fixed guide tube 74, the assembly of which is substantially shown in FIG. 11. A minor modification in the fixed guide tube 74*a* is also shown in FIG. 11 in the provision of a reduced opening 83 beyond the larger portion 84 required to accommodate the sliding travel of the shorter moving guide tube 76 common to both FIG. 11 and FIGS. 6 and 8** embodiments.

Figure 11:
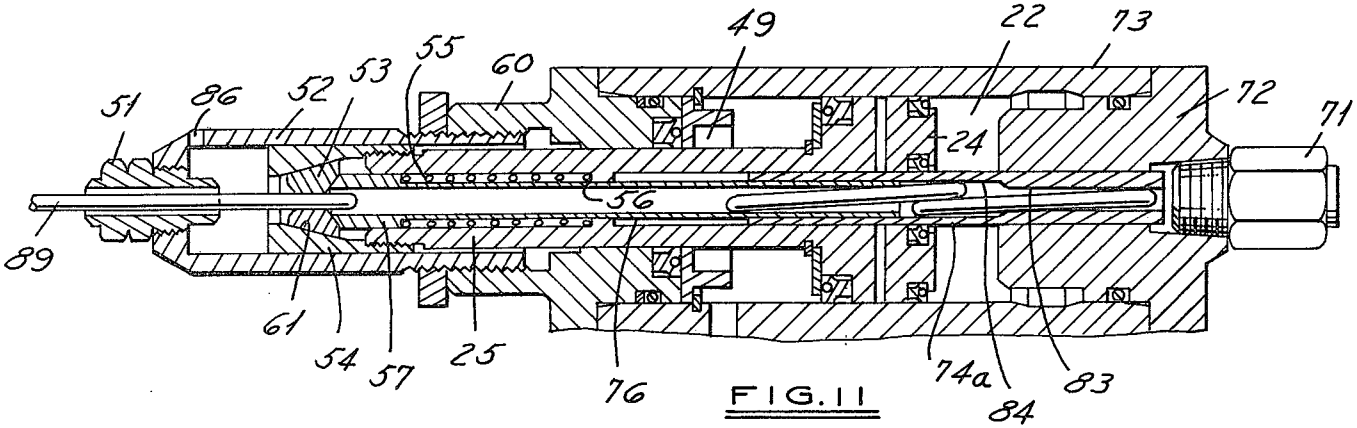
FIG. 11 is a fragmentary sectional view like FIG. 10 showing assembled components of FIGS. 6 and 8 with only a slight modification.

The longer movable tube **76*a* of FIG. 10 is preferred to avoid any possibility of mandrel overlapping and jamming as shown at 85 in FIG. 11 in the area beyond the discharge end of the movable tube 76 and the inherently larger telescoping end of the fixed tube 74 or 74*a* accommodating the sliding movement of the movable tube 76. Such jamming may occur unless in the operation of the tool each mandrel completes its travel through the tubular passage to the mandrel receptacle box G before the next one enters such tubular passage. In some instances prior to the improvement of the FIG. 10 embodiment, when operating the tool at maximum speed or with a kink in the flexible hose line, vacuum could shut off in the mandrel tube before completion of its travel to the receptacle box causing it to fall back into a potential jamming position within the tool housing when the trigger was pulled for retracting the succeeding mandrel. In the case of a preceding mandrel lodging in the fixed tube 74 or 74*a* with another overlying in a jammed condition as shown at 85 in FIG. 11, successive reciprocation of the moving tube 76 could cause a serious bursting pressure on the guide tubes and severe damage to the tool. Even with a partially restricted fixed tube 74*a* as shown at 83 in FIG. 11, the potential of jamming was found to exist as illustrated particularly with mandrels of minimum diameter within the range of sizes handled by the tool; however, by developing the modification of FIG. 10 wherein the moving tube 76*a* extends throughout the fixed tube 74 to a hose connection external of the hand tool, any jamming problem leading to tool damage under high hydraulic rivet setting pressure applied to piston 24 was entirely solved since all portions of the tube passage within the tool move with the piston 24 upon retraction of the mandrel, thus even if overlapping of mandrels occurs within the movable tube 76*a*** inside the tool, only manual insertion pressure of a new rivet mandrel can be applied to the blocking mandrels which is insufficient to cause any damage.

A further modification to improve the reliability of mandrel passage to the receptacle box G was made by incorporating one or more air holes 86 in the nose sleeve 52 providing an auxiliary air passage for the mandrel tube particularly useful when insertion of a new mandrel 89 into the nose piece 51 partially blocks air passage therethrough.

The combination of these features has been found to materially improve the reliability of the mandrel retrieval system without necessitating continuous vacuum applied to the mandrel tubular passage which, as discussed in relation to the first embodiment, materially slows the operating cycle time.

In all respects not otherwise described above the embodiments of FIGS. 10 and 11 are identical to the first embodiment and are so numbered.

Applicants disclaim any terminal part of the term of the patent to be granted on this application which may extend beyond the patent issuing on copending application Ser. No. 705,686.

We claim:

1. A riveting system comprising a power operated rivet setting tool having a housing, a nose piece fixed on said housing for receiving a rivet with an attached mandrel projecting within said housing, power actuated means within said housing including mandrel gripping jaws adapted to engage and retract said mandrel to effect the setting of a rivet in a workpiece and separation of its mandrel, means for returning said jaws to an advanced open position releasing said mandrel, tubular means extending from said mandrel gripping jaws to a mandrel collecting receptacle remote from said housing, vacuum means for producing an air flow through said tubular means effective upon release of said mandrel for conducting said mandrel to said collecting receptacle, and an air passage means communicating with the entrance to said tubular means bypassing any rivet mandrel positioned within said nose piece to minimize air flow restriction for conducting a mandrel to said collecting receptacle.

2. A riveting system as set forth in claim 1 including means for supplying hydraulic pressure as fluid pressure to retract said mandrel.

3. A riveting system as set forth in claim 1 wherein said tubular means extends through said piston means.

4. A riveting system comprising a power operated rivet setting tool having a housing, a nose piece fixed on said housing for receiving a rivet with an attached mandrel projecting within said housing, power actuated means within said housing including mandrel gripping jaws adapted to engage and retract said mandrel to effect the setting of a rivet in a workpiece and separation of its mandrel, means for returning said jaws to an advanced open position releasing said mandrel, tubular means extending from said mandrel gripping jaws to a mandrel collecting receptacle remote from said housing, vacuum means for producing an air flow through said tubular means effective upon release of said mandrel for conducting said mandrel to said collecting receptacle, means for converting air pressure to hydraulic pressure to provide power for retracting said mandrel, venturi means for converting air pressure and flow to vacuum for producing air flow through said tubular means, and means for blocking air flow for said venturi means during the mandrel retracting cycle of said riveting system.

* * * * *